US010327528B2

(12) United States Patent
Cowdry et al.

(10) Patent No.: US 10,327,528 B2
(45) Date of Patent: Jun. 25, 2019

(54) HAIR STYLING APPLIANCE

(71) Applicant: Dyson Technology Limited, Wiltshire (GB)

(72) Inventors: Guy Francis Charles Cowdry, Swindon (GB); Richard David Nicolaou, Swindon (GB)

(73) Assignee: Dyson Technology Limited, Malmesbury, Wiltshire (GB)

( * ) Notice: Subject to any disclaimer, the term of this patent is extended or adjusted under 35 U.S.C. 154(b) by 183 days.

(21) Appl. No.: 15/374,582

(22) Filed: Dec. 9, 2016

(65) Prior Publication Data

US 2017/0164707 A1 Jun. 15, 2017

(30) Foreign Application Priority Data

Dec. 9, 2015 (GB) ..... 1521716.9

(51) Int. Cl.

| | |
|---|---|
| ***H05B 3/34*** | (2006.01) |
| ***H05B 3/10*** | (2006.01) |
| ***H05B 3/20*** | (2006.01) |
| ***A45D 2/00*** | (2006.01) |
| ***H05B 3/06*** | (2006.01) |

(52) U.S. Cl.
CPC ..... *A45D 2/001* (2013.01); *H05B 3/06* (2013.01)

(58) Field of Classification Search
CPC ..... H05B 3/10; H05B 3/20–3/38
See application file for complete search history.

(56) References Cited

U.S. PATENT DOCUMENTS

| | | | | | |
|---|---|---|---|---|---|
| 3,170,469 | A * | 2/1965 | Solomon | A45D 2/18 | 132/262 |
| 3,556,114 | A * | 1/1971 | Simon | A45D 2/2478 | 132/262 |
| 4,242,567 | A * | 12/1980 | Carter | A45D 2/001 | 132/224 |
| 4,917,078 | A * | 4/1990 | Zaborowski | A45D 1/02 | 126/409 |
| 5,887,599 | A * | 3/1999 | Habibi | A45D 2/18 | 132/205 |
| 8,230,868 | B2 | 7/2012 | Choi | | |

(Continued)

FOREIGN PATENT DOCUMENTS

| | | |
|---|---|---|
| CN | 1833571 | 9/2006 |
| CN | 202634728 | 12/2012 |

(Continued)

OTHER PUBLICATIONS

Search Report dated Apr. 27, 2016, directed to GB Application No. 1521716.9; 1 page.

(Continued)

*Primary Examiner* — Michael A Laflame, Jr.
(74) *Attorney, Agent, or Firm* — Morrison & Foerster LLP

(57) ABSTRACT

A heating plate for a hair styling appliance, the heating plate having a length, a depth and a width. The heating plate includes a first continuous hair facing surface and a second surface opposite the first surface. The heating plate includes at least one groove which run across the width of the heating plate, each groove extends from the second surface towards the first surface and allows the heating plate to flex.

27 Claims, 11 Drawing Sheets

(56) References Cited

U.S. PATENT DOCUMENTS

| | | | | |
|---|---|---|---|---|
| 8,927,910 | B2 * | 1/2015 | Wirtz | H05B 3/10 219/539 |
| 9,420,861 | B1 * | 8/2016 | Israel | A45D 2/001 |
| 9,848,683 | B2 * | 12/2017 | Sayers | A45D 1/04 |
| 2006/0196523 | A1 | 9/2006 | Choi | |
| 2010/0101599 | A1 | 4/2010 | Choi | |
| 2010/0116818 | A1 * | 5/2010 | Gabbay | A47J 37/0709 219/528 |
| 2011/0083695 | A1 | 4/2011 | Abbasi et al. | |
| 2012/0145357 | A1 * | 6/2012 | Moon | F28D 15/0233 165/104.26 |
| 2012/0227758 | A1 * | 9/2012 | Ford | A45D 1/04 132/211 |
| 2012/0271324 | A1 * | 10/2012 | Yannone | A61B 17/0483 606/144 |
| 2013/0263881 | A1 | 10/2013 | Story | |
| 2014/0124499 | A1 * | 5/2014 | Wei | H05B 3/24 219/541 |
| 2014/0332023 | A1 * | 11/2014 | Kaizuka | A45D 2/002 132/118 |
| 2015/0296567 | A1 * | 10/2015 | Tuengler | H05B 3/347 219/543 |
| 2016/0302546 | A1 * | 10/2016 | Fan | A45D 1/04 |

FOREIGN PATENT DOCUMENTS

| | | |
|---|---|---|
| CN | 103315503 | 9/2013 |
| EP | 2 106 195 | 9/2009 |
| EP | 2 745 728 | 6/2014 |
| GB | 2 405 584 | 3/2005 |
| GB | 2 431 326 | 4/2007 |
| GB | 2 442 614 | 4/2008 |
| GB | 2545233 | 6/2017 |
| JP | 2001-104036 | 4/2001 |
| JP | 3153008 | 8/2009 |
| JP | 2013-20854 | 1/2013 |
| KR | 10-0858147 | 9/2008 |
| KR | 10-2010-0120876 | 11/2010 |
| KR | 20-2013-0005054 | 8/2013 |
| WO | 2008/062293 | 5/2008 |
| WO | WO-2009/007823 | 1/2009 |
| WO | WO-2012/093045 | 7/2012 |
| WO | WO-2014/056957 | 4/2014 |

OTHER PUBLICATIONS

International Search Report and Written Opinion dated Feb. 22, 2017, directed to International Application No. PCT/GB2016/053691; 10 pages.

* cited by examiner

E-E

HAIR STYLING APPLIANCE

REFERENCE TO RELATED APPLICATIONS

This application claims the priority of United Kingdom Application No. 1521716.9, filed Dec. 9, 2015, the entire contents of which are incorporated herein by reference.

FIELD OF THE INVENTION

The present invention relates to a hair styling appliance. Heated hair styling appliances are designed to use the action of heat and, optionally mechanical means to form hair into a desired shape or style.

BACKGROUND OF THE INVENTION

In particular the present invention relates to a heating plate for a hair straightener, otherwise known as a hair styling iron. Hair straighteners conventionally include two articulated arms which are pivotally attached to each other at one end and to which one or more heating plates are attached at the other end. Where both arms have a heating plate they are generally positioned on inner opposed surfaces of the arms. The heating plates generally have hair contacting surfaces which are designed to come into contact with hair to be styled during use of the hair straighteners. Such a straightener can be seen in WO2014/056957.

Heating plates for hair straighteners are conventionally made from a solid metal, ceramic or a combination of the two. They are also often resiliently mounted to the arm of the hair straightener such that they can move up and down or rock slightly as hair is pressed between the two arms. These resilient mounts help to ensure that hair pressed between the heating plates isn't subjected to too much pressure. They can also help to ensure that the plates remain flat and parallel during use. An example of such a resilient mounting can be seen in EP2745728.

In order to reduce the damage to hair caused by over compression, hair straighteners have been described where the heating plate, or an opposed surface which contacts the heating plate is segmented to help it conform to the hair which is pressed between the arms of the straightener. Examples of such schemes are shown in EP2745728 and US2011/0083695. A problem does exist with such schemes however in that strands of hair can get trapped between the segments during use of the hair straightener.

It is therefore desirable to provide an improved heating plate and hair straightener.

SUMMARY OF THE INVENTION

A first aspect of the present invention therefore provides a heating plate for a hair styling appliance, the heating plate having a length a depth and a width, the heating plate comprising a first continuous hair facing surface and a second surface opposite the first surface, the heating plate comprising at least one groove which run across the width of the heating plate, each groove extends from the second surface towards the first surface and allows the heating plate to flex.

This invention is advantageous because the at least one groove allows the heating plate to flex but the first continuous hair facing surface ensures that hair does not get trapped. The word "continuous" means that the first surface has no joints and is unbroken. The first surface is preferably formed from a single piece. In a preferred embodiment there may be a plurality of grooves.

In a preferred embodiment the first surface is smooth. In a preferred embodiment the first surface may be flat. It is possible that the first surface could be slightly curved or have an undulating surface as long as it is continuous. In a particular embodiment the heating plate may be rectangular in shape.

In a particularly preferred embodiment the whole heating plate may be monolithic.

A layer is preferably formed between the first surface and the top of each of the grooves. The layer may have a depth (D2) of from 0.001 mm to 1 mm. In a preferred embodiment the depth (D2) may be from 0.01 mm to 0.1 mm Most preferably the depth (D2) of the layer is 0.05 mm. This layer is preferably thin enough to be able to flex.

The depth (D1) of the heating plate may be from 0.01, or 0.06, or 0.5, or 1, or 3 to 5, or 7, or 10 mm. In a particular embodiment the depth (D1) of the heating plate may be from 0.06 mm to 2 cm. In a most preferred embodiment the depth (D1) of the heating plate is 3 mm Preferably the ratio between the depth (D2) of the layer and the depth (D1) of the heating plate is 1:60.

In a particular embodiment there are from 20, or 30, or 40, or 50 to 60, or 70, or 80, or 90 to 100 grooves. In a preferred embodiment there are 80 grooves. Each groove 16 may be from 0.01, 02 0.1, or 0.2, or 0.3, or 0.4 to 0.5, or 0.6, or 0.7, or 0.8, or 0.9 mm wide. Ideally each groove is 0.4 mm wide. The heating plate is preferably from 20, or 40, or 60, to 80, or 100, or 125, or 150 to 200 mm in length. Ideally the heating plate is 90 mm in length.

Walls are preferably present on each side of each groove and the walls define the grooves. The walls are preferably from 0.01, or 0.2, or 0.4, or 0.6, or 1 to 1.2, or 1.4, or 1.6, or 2 mm wide. Preferably the walls are 0.6 mm wide. In a particularly preferred embodiment the walls are wider than the grooves as this helps to increase the thermal mass of the heating plate.

The heating plate may be formed from any suitable material, for example Aluminium, Copper, Steel, Titanium or Beryllium Copper. The heating plate can be manufactured using any suitable method. The layer may be formed in one piece and the walls may then be added to the layer to form the heating plate. Alternatively the whole heating plate may be formed in one piece and may therefore be monolithic.

The heating plate may be formed using any suitable technique, for example by the use of extrusion, casting, wire cutting, computer numerical control machining (CNC), laser cutting, water jets, electro discharge machining (EDM), precision electro chemical machining (PECM) or additive manufacture.

The heating plate may further comprise a first channel which runs along the length of a side of the heating plate. Preferably a first channel is arranged on both sides of the heating plate. The first channel(s) ideally house a first strip of material which is softer than the remainder of the heating plate. It may have a shore value which is lower than the shore value of the heating plate. The first strip of material may be arranged to protrude slightly from the first channel such that the top of the first strip of material is level with the first surface of the heating plate. This first strip of material can therefore act as a protective smooth edge.

The heating plate may also further comprise a second channel which runs along the length of a side of the heating plate. Ideally a second channel will be arranged on both sides of the heating plate. The second channel(s) preferably house a resilient member. The resilient member may be a strip of resilient material which runs the length of the second channel(s). Alternatively the resilient member may be one or more springs located within the second channel(s). The resilient member is also preferably less conductive than the heating plate. The resilient member advantageously may help to allow the heating plate to flex when pressure is applied to the first surface of the heating plate. The resilient member may help to allow local flexing of an area of the heating plate.

In a particular embodiment the heating plate may further comprise an elongate recess formed in the second surface. The elongate recess may extend the full length (L) of the heating plate.

A second aspect of the present invention provides a hair straightener comprising a heating plate as described above. In a preferred embodiment the hair straighteners comprise first and second arms which are connected such that they can move between an open position and a closed position for the purpose of gripping hair.

Such hair straighteners are advantageous over prior hair straighteners because whilst the heating plate is flexible and therefore hair being straightened is subjected to controlled pressure, the first continuous hair facing surface is formed in one piece and therefore hairs cannot become trapped. This may advantageously reduce hair breakage and may improve the final style of the straightened hair.

Ideally each arm has a heating plate arranged such that the first continuous hair facing surfaces are opposed and are brought together when the arms are moved into the closed position. In a particular embodiment only one of the heating plates may have the structure described above. The additional plate may be a rigid plate or a rigid plate which is resiliently mounted. However in a preferred embodiment both of the heating plates may have the structure described above and they may both therefore be capable of flexing.

BRIEF DESCRIPTION OF THE DRAWINGS

In order that the present invention may be more readily understood, an embodiment of the invention will now be described, by way of example, with reference to the accompanying drawings, in which.

DETAILED DESCRIPTION OF THE INVENTION

Figure 1:
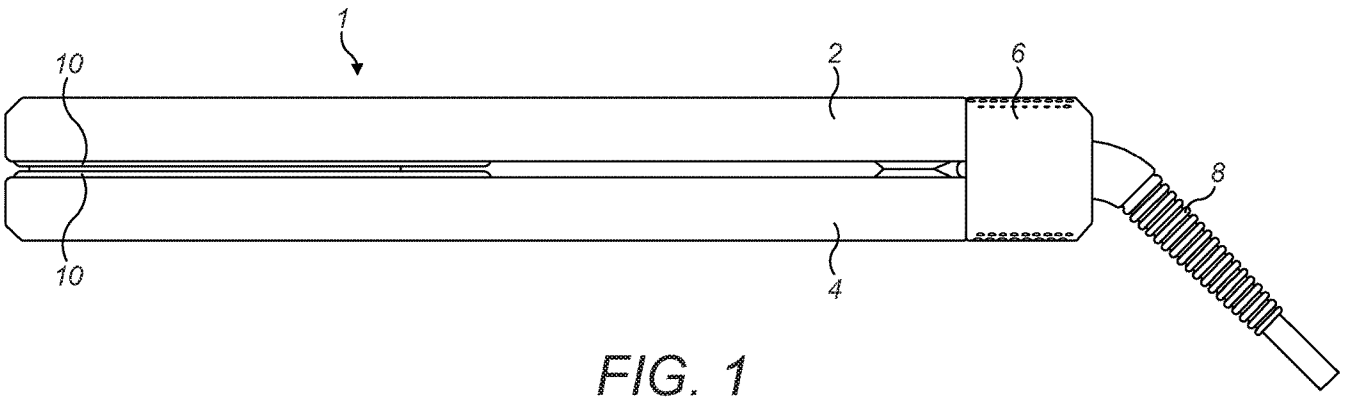
FIG. 1 is a side view of a hair straightener according to the present invention.
Figure 2:
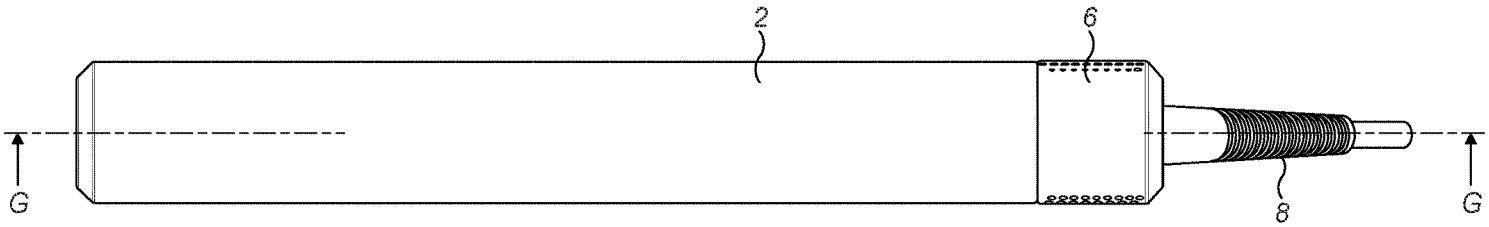
FIG. 2 is a top view of the hair straightener shown in FIG. 1.

The hair straightener 1 shown in FIGS. 1 to 4*c* can be seen to comprise a first arm 2 and a second arm 4 which are joined together at one end by a hinge 6. A power supply cable 8 is located at the hinge end of the hair straightener.

Figure 4A:
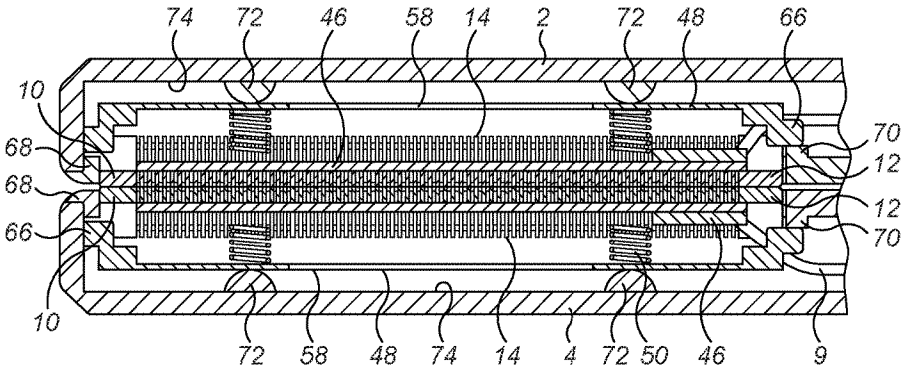
FIG. 4*a* is a close up of the area H shown in FIG. 3.
Figure 4B:
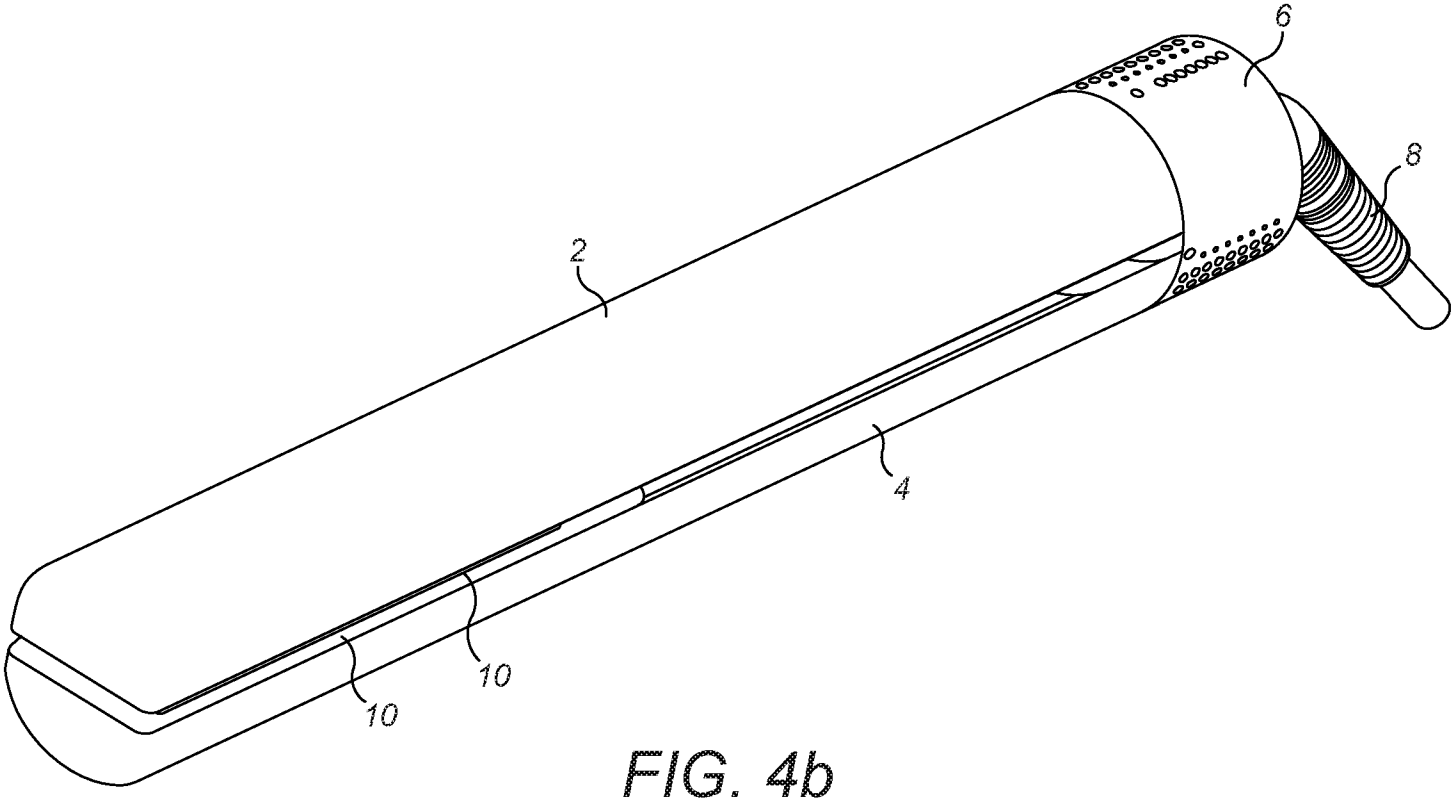
FIG. 4*b* is a perspective view of the hair straighteners shown in FIG. 1 with the arms in the closed position.
Figure 4C:
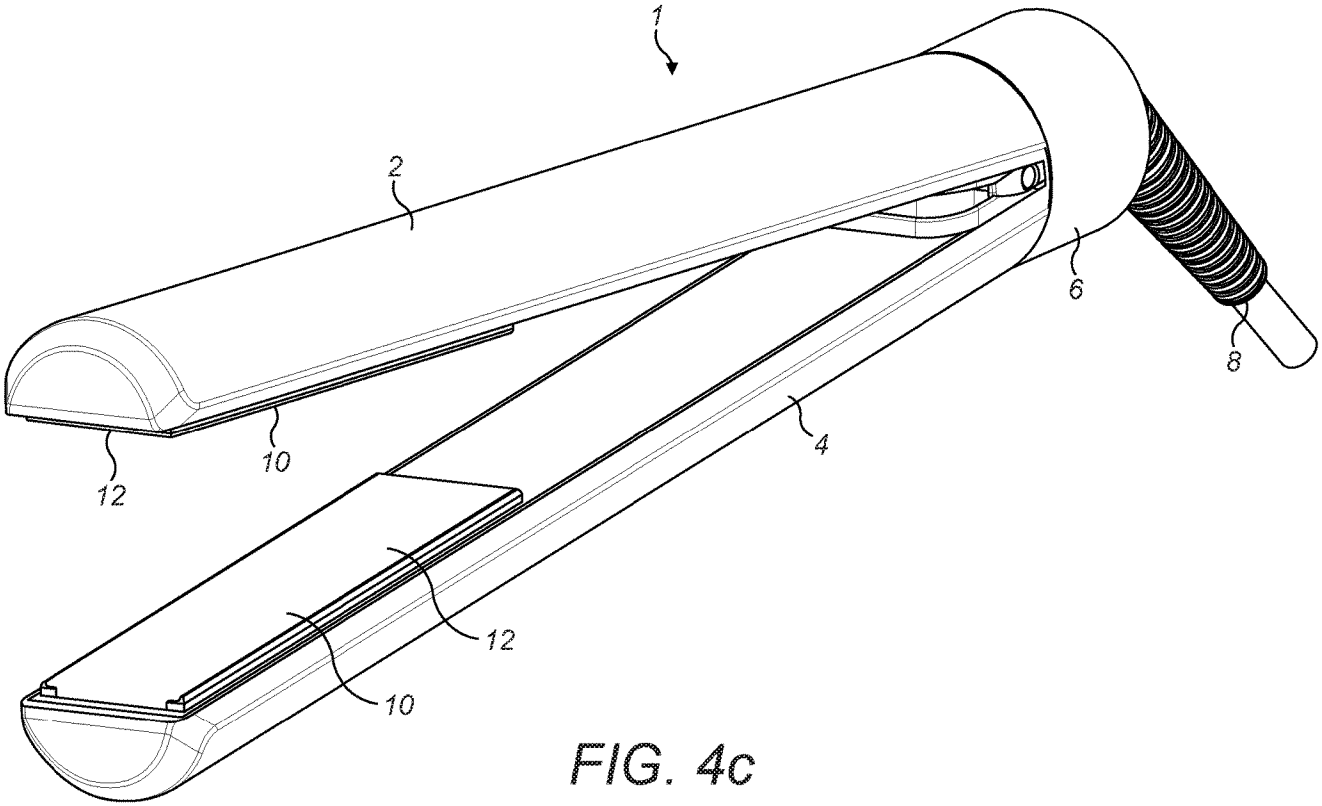
FIG. 4*c* is a perspective view of the hair straighteners shown in FIG. 1 with the arms in the open position.

Each arm 2, 4 further comprises a heating plate 10 located at the end of the arm furthest from the hinge 6. Wiring 9 from the power supply cable 8 connects to a printed circuit board (PCB) 11 which controls the hair straighteners 1. Each heating plate 10 has a hair contacting surface 12 and an opposed outer surface 14. The hair contacting surfaces 12 on each plate 10 are arranged such that they face each other. The arms 2, 4 are hinged such that they can move between an open position, as shown in FIG. 4*c*, where the hair contacting surfaces 12 are spaced apart and a closed position, as shown in FIG. 4*b*, where the hair contacting surfaces 12 are brought together such that hair to be straightened can be held between the hair contacting surfaces 12.

Figure 5:
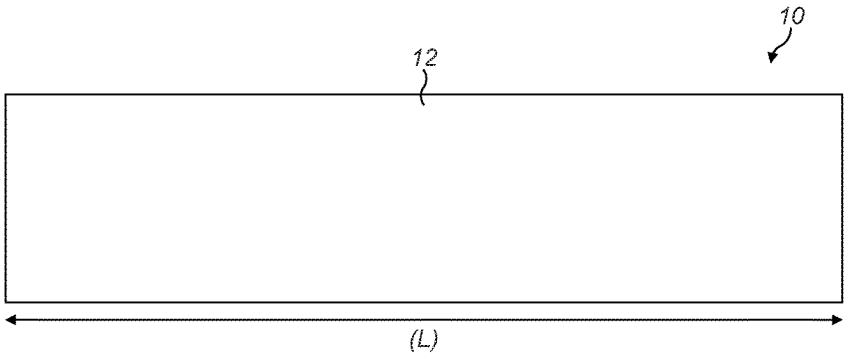
FIG. 5 is a top view of a heating plate according to a first embodiment, showing the hair contacting surface.
Figure 6A:
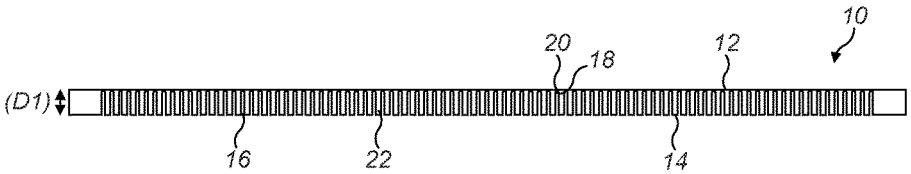
FIG. 6*a* is a side view of the heating plate shown in FIG. 5.
Figure 6B:
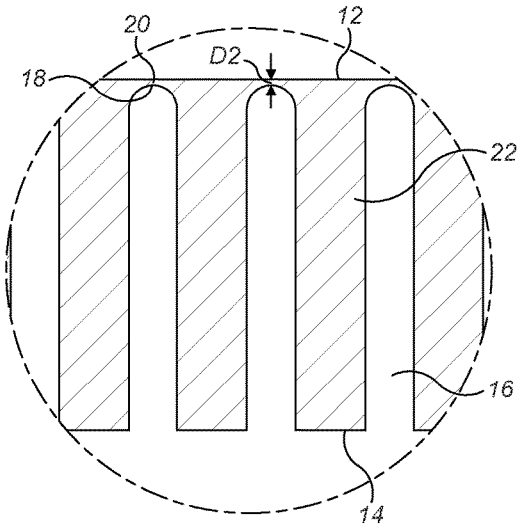
FIG. 6*b* is an enlarge view of a portion of the heating plate shown in FIG. 6*a;*
Figure 6C:
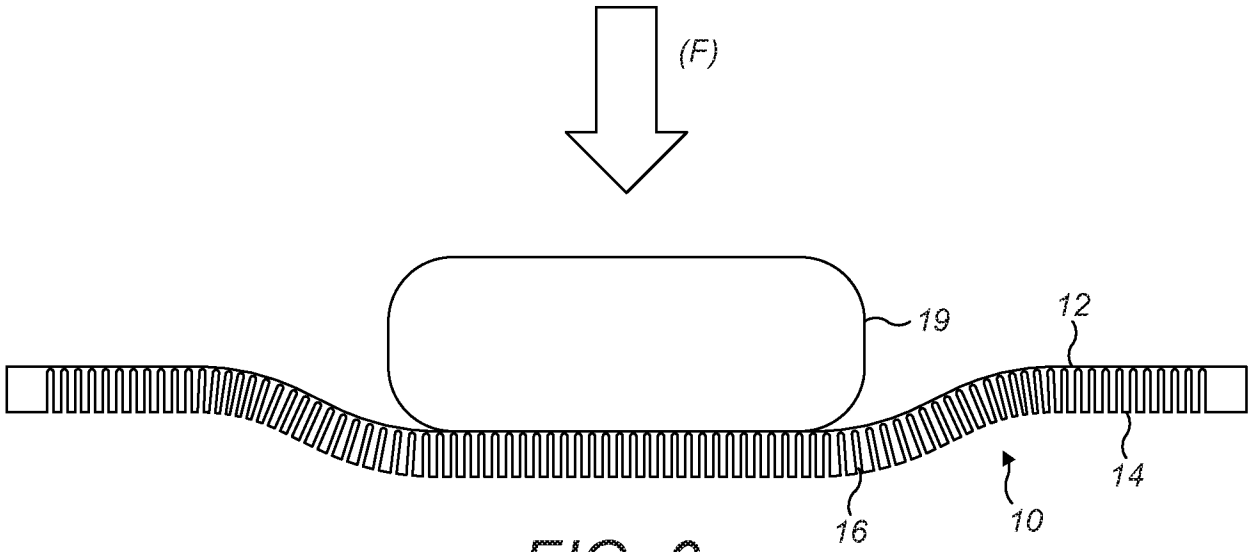
FIG. 6*c* shows the heating plate shown in FIGS. 5 and 6*a*-6*b* flexing under pressure.
Figure 7:
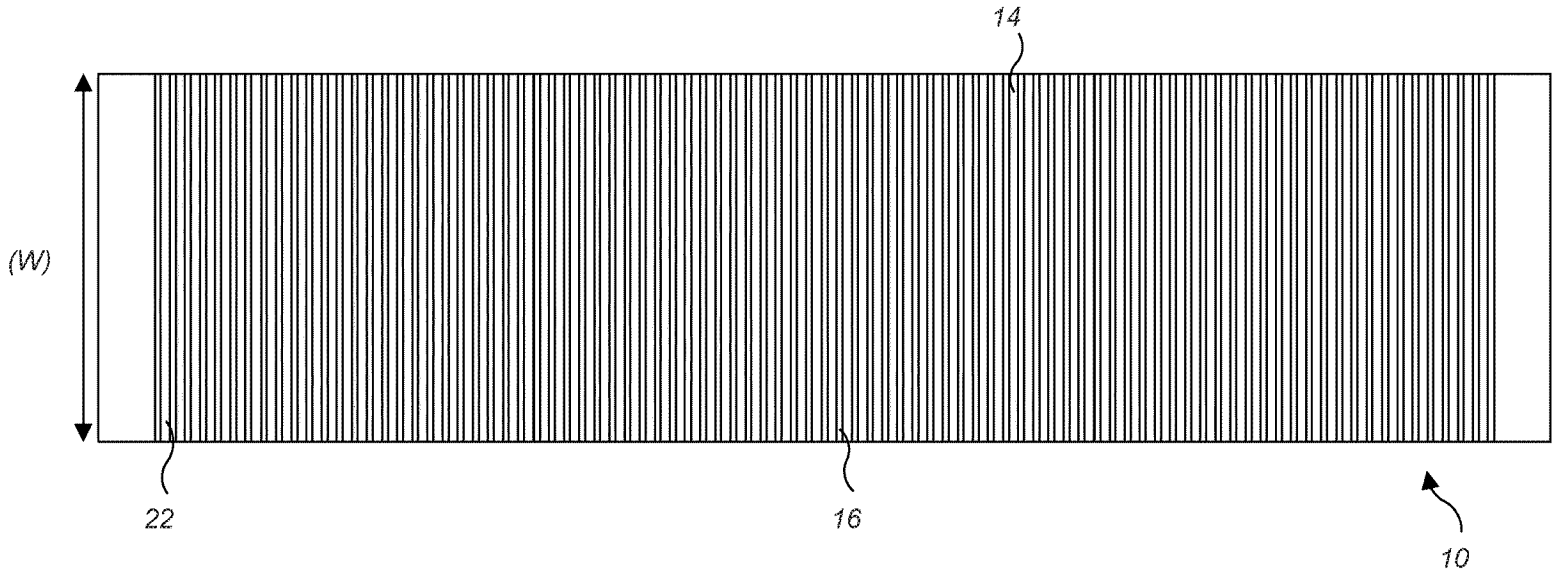
FIG. 7 is a view of the underside of the heating plate shown in FIGS. 5 and 6*a*-6*c;*

FIGS. 5 to 7 show a first embodiment of the heating plate 10 which may be located on each arm 2, 4 of the hair straightener 1.

It can be seen that the heating plate 10 has a smooth hair contacting surface 12 which is formed in a single piece and in the embodiment shown is flat. The hair contacting surface 12 is rectangular in shape. The heating plate 10 may be formed from any suitable material which can transfer heat from the heating plate 10 to the hair to be straightened. Examples of suitable materials are metals and alloys of metals such as Aluminium, Copper, Steel, Titanium and Beryllium Copper.

The heating plate 10 has an opposed surface 14 which is opposite the hair contacting surface. The whole heating plate 10 is ideally formed in one piece or from one piece of material. The heating plate 10 can be seen to have a length (L) a depth (D1) and a width (W). The heating plate 10 can be seen to have a plurality of grooves 16 each of which runs across the full width (W) of the heating plate 10. Each groove 16 extends from the opposed surface 14 towards the hair contacting surface 12. The grooves 16 stop short of the hair contacting surface 12. The grooves 16 allow the heating plate 10 to flex. This flexing can be seen in FIG. 6*c*. It can be seen that when a downward force (F) is applied to the hair contacting surface 12, for example when a tress of hair 19 is sandwiched between the first arm 2 and the second arm 4 and the arms 2, 4 are pressed together, the heating plate 10 flexes.

A layer 20, shown best in FIG. 6*b*, of the heating plate 10, is formed between the top 18 of the grooves 16 and the hair contacting surface 12. This layer has a depth (D2) of from 0.001 mm to 1 mm, ideally the depth (D2) is 0.05 mm. The depth (D1) of the heating plate 10 is from 0.01 mm to 10 cm. Ideally the depth (D1) of the heating plate 10 is 3 mm Preferably the ratio between the depth (D2) of the layer 20 and the depth (D1) of the heating plate 10 is 1:60.

Preferably there are from 20 to 100 grooves 16. In a preferred embodiment there are 80 grooves. Each groove 16 may be from 0.01 to 10 mm wide. Ideally each groove is 0.4 mm wide. Walls 22 are present on each side of each groove 16. The walls 22 help to define the grooves 16. The walls 22 are preferably from 0.01 mm to 10 mm wide. Preferably the walls 22 are 0.6 mm wide. In a particularly preferred embodiment the walls 22 are wider than the grooves 16 as this helps to increase the thermal mass of the heating plate 10.

The heating plate 10 is preferably from 20 mm to 200 mm in length. Ideally the heating plate 10 is 90 mm in length.

The heating plate 10 can be manufactured using any suitable method. The layer 20 may be formed in one piece and the walls may then be added to the layer 20 to form the heating plate 10. Alternatively the whole heating plate 10 may be formed in one piece and may therefore be monolithic.

Suitable methods of manufacture include the use of extrusion, casting, wire cutting, computer numerical control machining (CNC), laser cutting, water jets, electro discharge machining (EDM), precision electro chemical machining (PECM) and additive manufacture.

Figure 8:
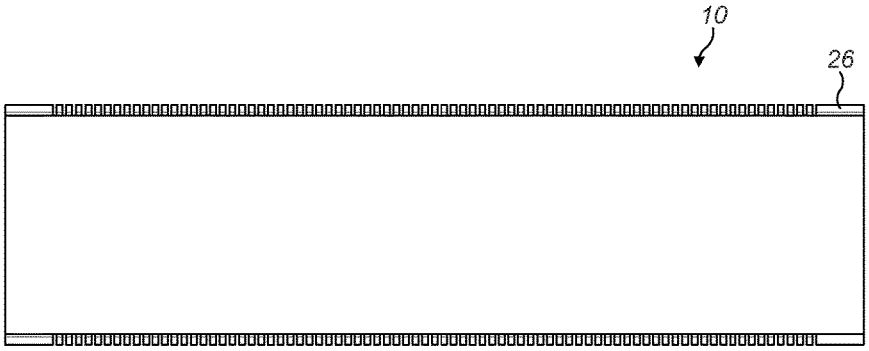
FIG. 8 is a top view of a heating plate according to a second embodiment, showing the hair contacting surface.
Figure 9:
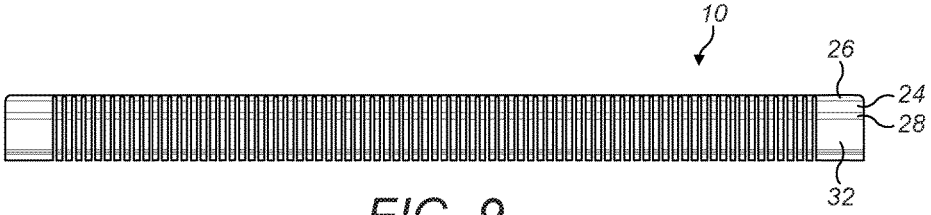
FIG. 9 is a side view of the heating plate shown in FIG. 8.
Figure 10:
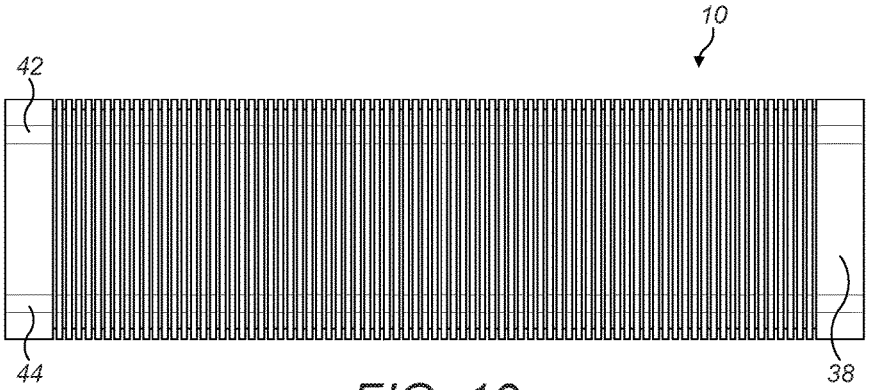
FIG. 10 is a view of the underside of the heating plate shown in FIGS. 8 and 7.
Figure 11:
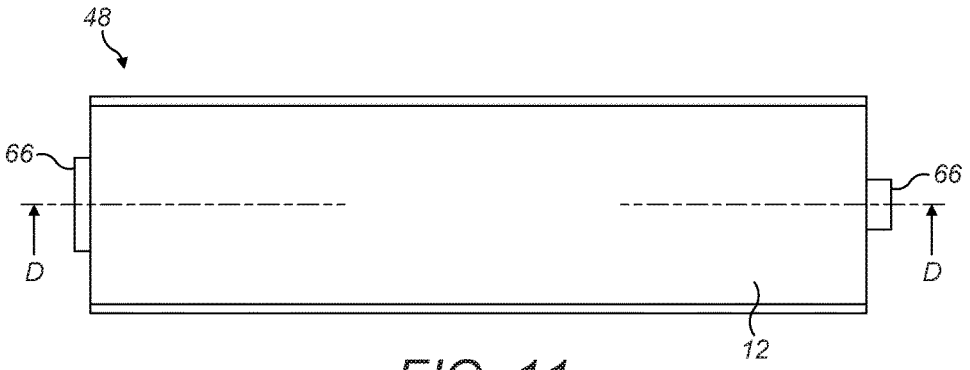
FIG. 11 is a plan view of a plate carrier having a heating plate as shown in FIGS. 8 to 10.
Figure 12:
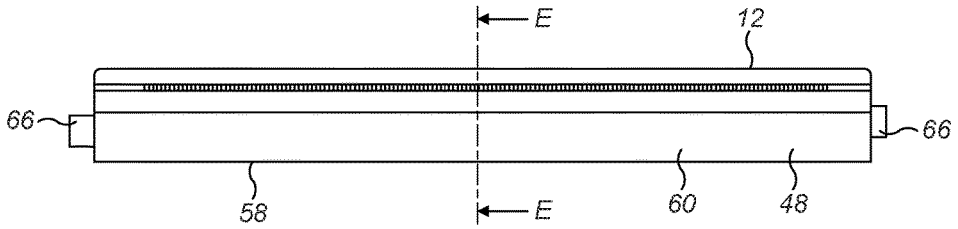
FIG. 12 is a side view of the plate carrier shown in FIG. 11.

A second embodiment of the heating plate 10 can be seen in FIGS. 8 to 10. The heating plate 10 in these figures has the same basic structure as in the first embodiment but it has a few additional features.

Figure 13:
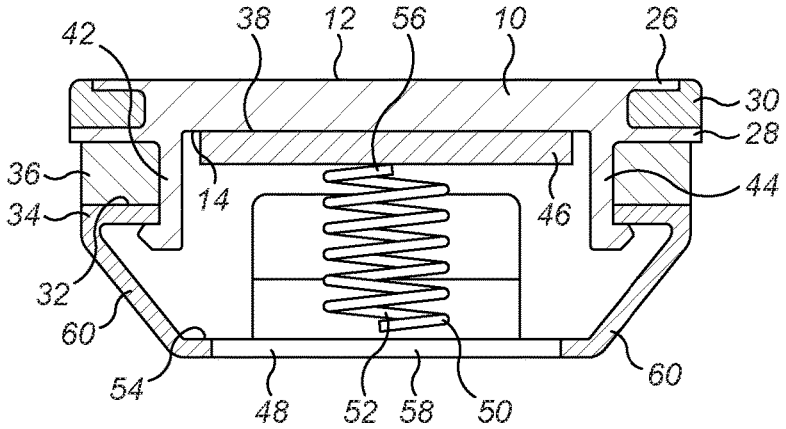
FIG. 13 is a section through the plate carrier shown in FIG. 12 taken along line E-E.
Figure 14:
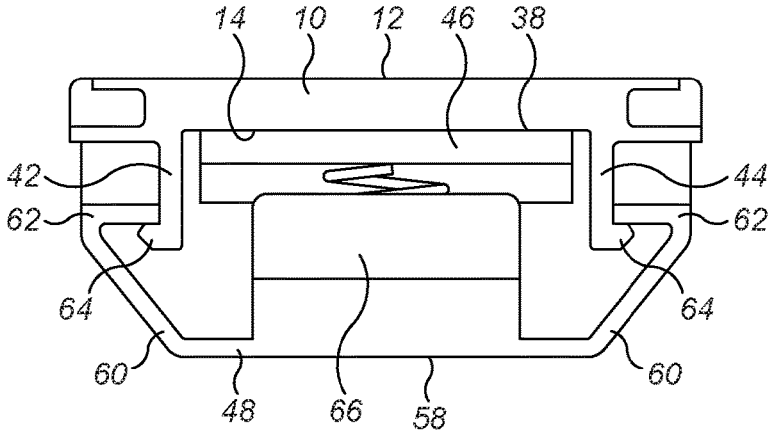
FIG. 14 is an end view of the plate carrier shown in FIGS. 11 to 13.
Figure 15:
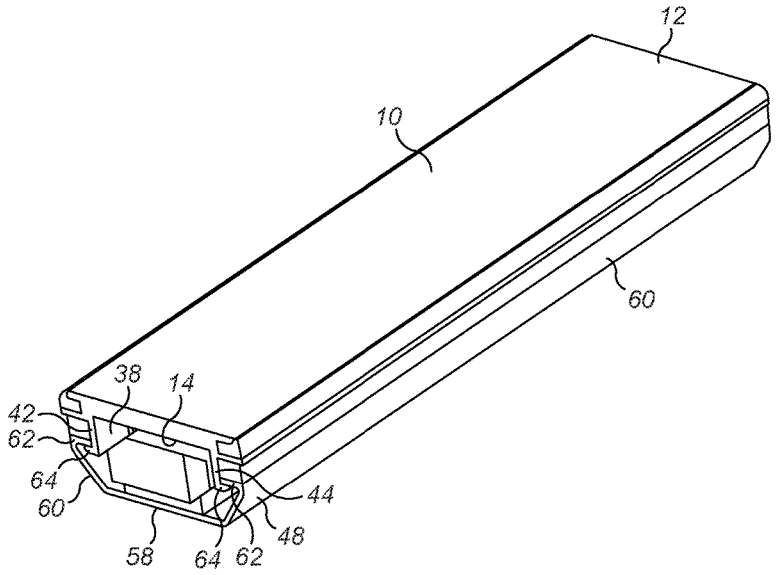
FIG. 15 is a perspective view of the plate carrier shown in FIGS. 11 to 14.
Figure 16:
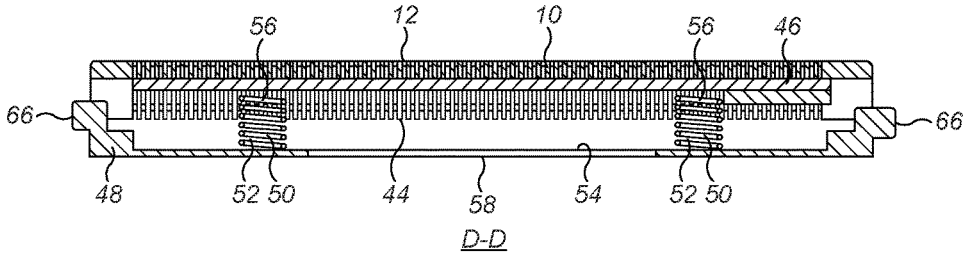
FIG. 16 is a section through the plate carrier shown in FIG. 11 taken along the line D-D.

In FIG. 9 it can be seen that a first channel 24 runs along the length of the side of the heating plate 10. A first channel 24 is preferably arranged on both sides of the heating plate 10. The first channel 24 is bounded by a first protruding wall 26 which runs parallel to the hair contacting surface 12 and a second protruding wall 28 which runs parallel to the first protruding wall. The first protruding wall 26 on each side can be seen in the plan view shown in FIG. 8. The first channel 24 on each side of the heating plate 10 is arranged to house a first strip of material 30. The first strip of material 30 preferably has a lower shore value than the remainder of the heating plate 10. The first strip of material 30 can be seen in FIG. 13. It can be seen in FIG. 13 that the first strip of material 30 protrudes slightly from the first channel 24 such that the top of the first strip of material 30 is level with the hair contacting surface 12 of the heating plate 10. This first strip of material 30 can therefore act as a smooth, soft edge to the hair contacting surface 12. This may help to protect a user during use of the hair straightener 1 as the edge will be softer than the remainder of the hair contacting surface 12.

In FIG. 9 it can be seen that a second channel 32 runs along the length of the side of the heating plate 10. A second channel 32 is preferably arranged on both sides of the heating plate 10. The second channel 32 is bounded by the second protruding wall 28 and a third protruding wall 34 which runs parallel to the first 26 and second 28 protruding walls. The second channel 32 on each side of the heating plate 10 is arranged to house a resilient member 36. The resilient member 36 is also preferably less conductive than the heating plate 10. Ideally the resilient member 36 is formed from silicone rubber. The resilient member 36 is preferably in the form of a strip of material which runs the length of the second channel 32. The resilient member 36 may alternatively may be formed from one or more springs arranged along the length of the second channel 32. The resilient member 36 acts to allow the heating plate 10 to flex when pressure is applied to the hair contacting surface 12, for example when hair to be straightened is clamped between the first and second arms 2, 4 of the hair straightener 1. The resilient member 36 in the form of a strip of material can be seen in FIG. 13.

From FIGS. 10 and 13 to 15 it can be seen that an elongate recess 38 is formed in the opposed surface 14 of the heating plate 10. This elongate recess 38 extends the full length (L) of the heating plate 10 and is bordered on its two long sides by a fourth 42 and a fifth 44 protruding wall.

In FIGS. 13 to 16 it can be seen that a heater 46 is located in the elongate recess 38 such that it is pressed against the opposed surface 14 of the heating plate 10. The heating plate 10 and heater 46 are mounted on a plate carrier 48. A resilient member, for example one or more springs 50 are mounted inside the plate carrier 48. The spring(s) 50 act to push the heater 46 against the opposed surface 14 of the heating plate 10. A first end 52 of the spring(s) 50 contacts the inner surface 54 of the plate carrier 48 and a second end 56 of the spring(s) 50 contact the heater 46. The aim is to maximise the amount of contact between the heater 46 and the opposed surface 14 of the heating plate 10.

The plate carrier 48 can be seen in more detail in FIGS. 11 to 17. The plate carrier 48 has an elongate lower wall 58 and a pair of elongate side walls 60 which extend upwardly from each side of the elongate lower wall 58. The elongate side walls 60 then turn towards the centre of the plate carrier 48 running parallel to the elongate lower wall 58 to provide first runners 62. These first runners 62 can engage with corresponding second runners 64 which are located on the free ends of the fourth and fifth protruding walls 42, 44. These first and second runners 62, 64 run the length (L) of the heating plate 10 and the plate carrier 48 and allow the heating plate 10 to be slid into position on the plate carrier 48 during construction. It can be seen that the second runners 64 are located underneath the first runners 62. This means that the heating plate 10, or a portion of it, can be moved toward the lower wall 58 against the action of the spring(s) 50 and the resilient members 36, if pressure is applied to the hair contacting surface 12 of the heating plate 10.

Figure 3:
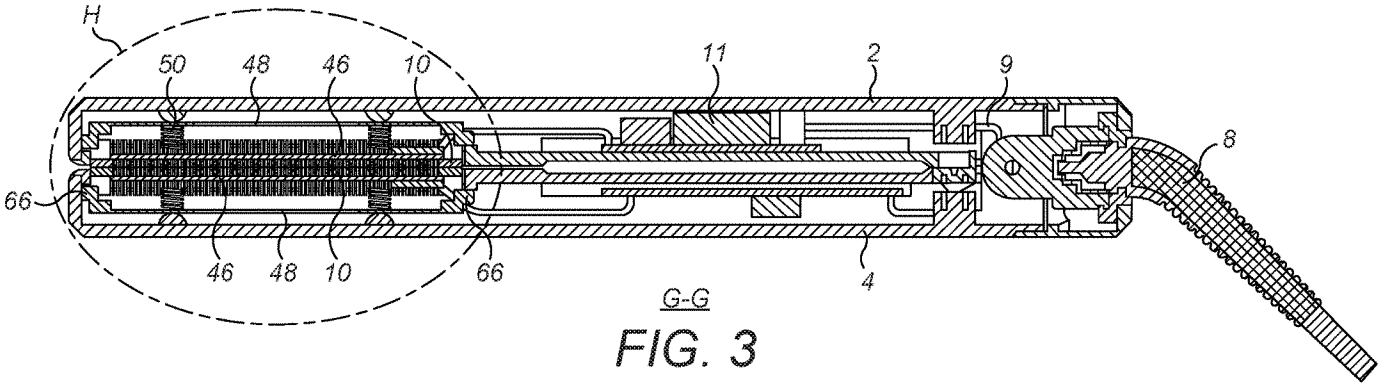
FIG. 3 is a section through line G-G shown in FIG. 2.

It can be seen in FIGS. 11, 12, 14 and 16 that the plate carrier 48 further comprises a pair of tabs 66 which are protrude outwardly from the lower wall 58 of the plate carrier 48. These tabs 66 are designed to engage with the arms 2, 4 of the hair straightener. FIGS. 3 and 4 show a pair of plate carriers 48 engaged in position on the hair straightener 1. One plate carrier 48 is engaged on the first arm 2 and one plate carrier 48 is engaged on the second arm 4. The tabs 66 engage on the arms 2, 4 behind forward retaining means 68 and rearward retaining means 70 located on the arms 2, 4 of the hair straightener 1. Each arm 2, 4 also has a plurality of resilient supports 72 which are located between the lower walls 58 of the plate carriers 48 and the inner wall 74 of the arms 2,4. These resilient supports 72 may be made of a resilient material for example silicone rubber or they may be in the form of springs. The resilient supports 72 allow the plate carriers 48 to move slightly if subjected to pressure. This means that in addition to the heating plates 10 being able to flex under pressure, they may also move as one piece towards the inner wall 74 of the arms 2, 4.

The invention claimed is:

1. A heating plate for a hair styling appliance, the heating plate having a length a depth and a width, the heating plate comprising a first continuous hair facing surface and a second surface opposite the first surface, the heating plate comprising at least one groove which runs across the width of the heating plate, each groove extends from the second surface towards the first surface and allows the heating plate to flex.

2. The heating plate of claim 1, wherein there are a plurality of grooves which run across the width of the heating plate, each groove extends from the second surface towards the first surface and allows the heating plate to flex.

3. The heating plate of claim 1, wherein the first surface is flat.

4. The heating plate of claim 1, which is monolithic.

5. The heating plate of claim 1, wherein the first surface is rectangular in shape.

6. The heating plate of claim 1, formed from Beryllium Copper.

7. The heating plate of claim 1, further comprising a layer which is formed between the first surface and the top of each of the grooves.

8. The heating plate of claim 7, wherein the layer has a depth of from 0.001 mm to 1 mm.

9. The heating plate of claim 8, wherein the depth of the layer is from 0.01 mm to 0.1 mm.

10. The heating plate of claim 8, wherein the ratio between the depth of the layer and a depth of the heating plate is 1:60.

11. The heating plate of claim 1, wherein there are from 20 to 100 grooves.

12. The heating plate of claim 1, wherein walls are present on each side of each groove and the walls define the grooves.

13. The heating plate of claim 12, wherein the walls are wider than the grooves.

14. The heating plate of claim 1, further comprising a first channel which runs along the length of a side of the heating plate.

15. The heating plate of claim 14, having a first channel arranged on both sides of the heating plate.

16. The heating plate of claim 14, wherein the first channel(s) house a first strip of material which is less conductive than the remainder of the heating plate.

17. The heating plate of claim 14, further comprising a second channel which runs along the length of a side of the heating plate.

18. The heating plate of claim 17, having a second channel arranged on both sides of the heating plate.

19. The heating plate of claim 17, wherein the second channel(s) house a resilient member.

20. The heating plate of claim 19, wherein the resilient member is a strip of material which runs the length of the second channel(s).

21. The heating plate of claim 1, further comprising an elongate recess formed in the second surface.

22. The heating plate of claim 21, wherein the elongate recess extends the full length of the heating plate.

23. A hair straightener comprising:

a heating plate for a hair styling appliance, the heating plate having a length a depth and a width, the heating plate comprising a first continuous hair facing surface and a second surface opposite the first surface, the heating plate comprising at least one groove which runs across the width of the heating plate, each groove extends from the second surface towards the first surface and allows the heating plate to flex.

24. The hair straightener of claim 23, further comprising first and second arms which are connected such that they can move between an open position and a closed position for the purpose of gripping hair.

25. The hair straightener of claim 23, wherein at least one of the arms has a heating plate.

26. The hair straightener of claim 25, wherein both arms have a heating plate.

27. The heating plate of claim 9, wherein the ratio between the depth of the layer and a depth of the heating plate is 1:60.

* * * * *